US008714377B2

(12) United States Patent
Peckham

(10) Patent No.: US 8,714,377 B2
(45) Date of Patent: May 6, 2014

(54) ENERGY ABSORBING COUPLER

(75) Inventor: Jason D. Peckham, Greenville, SC (US)

(73) Assignee: Wabtec Holding Corp., Wilmerding, PA (US)

( * ) Notice: Subject to any disclaimer, the term of this patent is extended or adjusted under 35 U.S.C. 154(b) by 138 days.

(21) Appl. No.: 13/362,045

(22) Filed: Jan. 31, 2012

(65) Prior Publication Data

US 2012/0199545 A1 Aug. 9, 2012

Related U.S. Application Data

(60) Provisional application No. 61/439,607, filed on Feb. 4, 2011.

(51) Int. Cl.
*B61G 9/20* (2006.01)

(52) U.S. Cl.
USPC ..... 213/65; 213/22

(58) Field of Classification Search
USPC ..... 213/22, 65
See application file for complete search history.

(56) References Cited

U.S. PATENT DOCUMENTS

| | | | |
|---|---|---|---|
| 325,923 | A | 9/1885 | Ferguson |
| 346,881 | A | 8/1886 | Zeigler |
| 472,328 | A | 5/1890 | Johnson |
| 1,344,780 | A | 6/1920 | Van Dorn |
| 1,468,057 | A | 9/1923 | Walker |
| 2,183,990 | A | 10/1937 | Dunn |
| 2,150,330 | A | 3/1939 | Kurtossy |
| 2,161,724 | A | 6/1939 | Scharfenberg |
| 2,246,406 | A | 6/1941 | Wittmer |
| 2,276,167 | A | 3/1942 | Dalton |
| 2,380,303 | A | 7/1945 | Geiger |
| 2,451,551 | A | 10/1948 | Haseltine |
| 2,504,253 | A | 4/1950 | Dath |
| 2,639,821 | A | 5/1953 | Danielson |
| 2,825,473 | A | 3/1958 | Metzger |
| 2,897,982 | A | 8/1959 | Larsson |
| 2,994,442 | A | 8/1961 | Frederick |
| 3,152,699 | A | 10/1964 | Vickerman |

(Continued)

FOREIGN PATENT DOCUMENTS

| | | |
|---|---|---|
| AT | 202184 | 2/1959 |
| AT | 250430 B | 11/1966 |

(Continued)

*Primary Examiner* — Zachary Kuhfuss
(74) *Attorney, Agent, or Firm* — The Webb Law Firm

(57) ABSTRACT

An energy absorbing coupler for railway vehicles includes a coupler anchor, a coupler mechanism supported to the coupler anchor by a deformation tube and draft gear element, and a plurality of energy absorbing devices associated with the coupler anchor. The energy absorbing devices each include two mating components in frictional engagement with one another. Sliding movement between contacting surfaces of the two components occurs when energy is applied to the coupler mechanism, thereby creating friction and dissipating the applied energy at least in part in the form of heat. The two mating components may include a male part, such as a mounting bolt, in mating engagement within a female part, such as a collar. An inside diameter of the collar may be slightly smaller than an outside diameter of the mounting bolt to create a press-fit engagement.

14 Claims, 11 Drawing Sheets

(56) References Cited

U.S. PATENT DOCUMENTS

| | | | | |
|---|---|---|---|---|
| 3,211,298 | A | | 10/1965 | Wilson et al. |
| 3,536,314 | A | | 10/1970 | Tönne et al. |
| 3,655,066 | A | | 4/1972 | Metzger |
| 3,715,139 | A | * | 2/1973 | Tuggle ..... 293/134 |
| 3,741,406 | A | * | 6/1973 | Anderson ..... 213/22 |
| 4,311,244 | A | | 1/1982 | Hindin et al. |
| 4,627,545 | A | | 12/1986 | Herbert et al. |
| 4,927,035 | A | | 5/1990 | Geng et al. |
| 5,139,161 | A | | 8/1992 | Long |
| 5,344,542 | A | | 9/1994 | Maher et al. |
| 5,503,280 | A | | 4/1996 | Hanano et al. |
| 5,509,548 | A | | 4/1996 | Kreher |
| 5,954,211 | A | | 9/1999 | Grau et al. |
| 6,390,314 | B1 | | 9/1999 | Grau et al. |
| 7,175,036 | B2 | | 2/2007 | Sommerfeld et al. |
| 7,467,724 | B2 | | 12/2008 | Voong et al. |
| 7,708,157 | B2 | | 5/2010 | Kemper |
| 2005/0145591 | A1 | | 7/2005 | Mattschull et al. |
| 2007/0084818 | A1 | | 4/2007 | Brabb et al. |
| 2009/0065317 | A1 | | 3/2009 | Gansweidt |

FOREIGN PATENT DOCUMENTS

| | | | |
|---|---|---|---|
| AT | 307493 | B | 4/1973 |
| AT | 375316 | B | 7/1984 |
| CA | 1229324 | A | 11/1987 |
| CH | 395172 | A | 7/1965 |
| CN | 2880620 | Y | 3/2007 |
| DE | 1017201 | B | 10/1957 |
| DE | 1021409 | B | 12/1957 |
| DE | 1530196 | A1 | 5/1970 |
| DE | 20120581 | U1 | 6/2003 |
| EP | 0583604 | A1 | 2/1994 |
| EP | 1447297 | A1 | 8/2004 |
| GB | 876173 | | 8/1961 |
| GB | 924143 | | 4/1963 |
| GB | 952058 | | 3/1964 |
| GB | 1296047 | | 11/1972 |
| GB | 1360248 | | 7/1974 |
| GB | 1393310 | | 5/1975 |
| JP | 958468 | A | 3/1997 |

* cited by examiner

ENERGY ABSORBING COUPLER

CROSS REFERENCE TO RELATED APPLICATIONS

This application is based upon U.S. Provisional Patent Application No. 61/439,607 entitled "Energy Absorbing Coupler", filed Feb. 4, 2011, which is hereby incorporated by reference for all purposes as set forth herein.

BACKGROUND OF THE INVENTION

1. Field of the Invention

The present invention is directed to force limiting, energy absorbing couplers for railway vehicles generally and having desired application in mass transit vehicles.

2. Description of Related Art

Overload shear release bolts/bushings are commonly used in mass transit car connectors known as couplers. The purpose behind these shear release bolts/bushings is to limit the maximum load transferred from the coupler to the car frame. Force levels otherwise would exceed this maximum load during a hard coupling or collision with another car. This situation could cause the two cars to sustain crush damage and could lead to passenger injury or death. During an impact, once the bolts/bushings shear and release, the coupler anchor slides back into a pocket in the transit car frame at zero load, absorbing no energy. In a typical application of overload shear release bolts/bushings, four shear release bolts secure a coupler anchor to the frame of a mass transit vehicle, such as a subway car. When there is a compressive force between two cars, the load is shared evenly through all four overload shear release bolts/bushings until a maximum load situation occurs such as during a hard coupling or collision when the bolts/bushings shear and release.

In another design, an energy-absorbing deformation tube is used in series with an overload shear release mechanism, such as the foregoing shear bolt/bushing design which is designed to break at the maximum load the car frame can handle. The deformation tube is set to collapse at a lower load than the foregoing shear bolt/bushing design.

It is generally known in the art to use friction draft riggings in railway vehicles as evidenced by U.S. Pat. No. 3,152,699 (Vickerman); U.S. Pat. No. 2,639,821 (Danielson); U.S. Pat. No. 2,504,253 (Dath); U.S. Pat. No. 2,451,551 (Haseltine); U.S. Pat. No. 2,380,303 (Geiger); and U.S. Pat. No. 2,276,167 (Dalton). Each of these patents incorporates a friction component for shock absorbing purposes. Additionally, U.S. Pat. No. 3,536,314 to Tönne discloses a friction spring for use in a buffer for a railroad vehicle in which frictional engagement between two rings is used to accommodate impact energy. U.S. Pat. No. 2,994,442 to Frederick discloses a kinetic energy absorbing device for a cushioning device in which frictional engagement between slidable shoes converts kinetic energy to heat.

SUMMARY OF THE INVENTION

An objective of this invention is to provide a force limiting, energy absorbing coupler that is relatively compact in size for railway vehicles such as mass transit cars and like vehicles. The energy absorbing coupler may be used as a replacement for couplers including overload shear release bolts/bushings (described in the foregoing), which are commonly found in mass transit car couplers. In one embodiment, mating engagement of a male element or part, for example, a shaft, in a female element or part, for example, a collar, creates friction as the male part interacts with the female part. The friction creates a constant force, and energy is absorbed into the two parts in the form of heat. While the energy absorbing coupler is described herein in detail in connection with use in mass transit vehicle coupler anchors, this specific use is intended to be non-limiting and the energy absorbing coupler has applications in railway vehicles generally.

In one embodiment, the energy absorbing coupler may comprise two mating components, namely, a male part and a female part. The inside diameter of the female part is slightly smaller than the outside diameter of the male part to create a desirable press-fit between the two parts or components. Due to this arrangement, the energy absorbing coupler can absorb energy at a predetermined load. For example, as the male part frictionally interacts within the female part as, for example, if the shaft of a mounting bolt is pulled through a collar, energy is absorbed in the form of heat into the two parts or components, namely, the mounting bolt and the collar. This energy dissipation in the form of heat is a result of the press-fit between the two parts or components creating a normal force to the mating faces or contacting surfaces therebetween, thus creating friction as one contacting surface slides over the other. Deformation may or may not take place in the two parts or components in this process. If deformation occurs, additional energy is correspondingly absorbed.

One embodiment of an energy absorbing coupler for railway vehicles comprises a coupler anchor and at least one energy absorbing device connected to the coupler anchor. The at least one energy absorbing device comprises two mating components in frictional engagement with one another, and energy applied to the energy absorbing coupler causes sliding movement between contacting surfaces of the two components thereby creating friction and dissipating the applied energy at least in part in the form of heat energy.

The two mating components may comprise a male part in mating engagement within a female part. The male part may comprise a mounting bolt and the female part may comprise a collar. An inside diameter of the collar may be slightly smaller than an outside diameter of the mounting bolt to create a press-fit engagement therebetween. The press-fit engagement creates a normal force between the contacting surfaces of the collar and the mounting bolt resulting in friction between the contacting surfaces when the energy applied to the energy absorbing coupler causes the sliding movement between the contacting surfaces.

The two mating components may comprise a male part within a female part and the frictional engagement therebetween may comprise a press-fit engagement. The press-fit engagement creates a normal force between the contacting surfaces of the male part and the female part resulting in friction between the contacting surfaces when the energy applied to the energy absorbing coupler causes the sliding movement between the contacting surfaces.

In another embodiment, an energy absorbing coupler for railway vehicles comprises a coupler anchor, a coupler mechanism supported to the coupler anchor by a deformation tube and a draft gear mechanism, and at least one energy absorbing device connected to the coupler. The at least one energy absorbing device comprises two mating components in frictional engagement with one another, and energy applied to the coupler mechanism causes sliding movement between contacting surfaces of the two components thereby creating friction and dissipating the applied energy at least in part in the form of heat energy. The draft gear mechanism may comprise resilient draft gear elements.

The two mating components may comprise a male part in mating engagement within a female part. The male part may comprise a mounting bolt and the female part may comprise a collar. An inside diameter of the collar may be slightly smaller than an outside diameter of the mounting bolt to create a press-fit engagement therebetween. The press-fit engagement creates a normal force between the contacting surfaces of the collar and the mounting bolt resulting in friction between the contacting surfaces when the energy applied to the coupler mechanism causes the sliding movement between the contacting surfaces.

The two mating components may comprise a male part within a female part and the frictional engagement therebetween may comprise a press-fit engagement. The press-fit engagement creates a normal force between the contacting surfaces of the male part and the female part resulting in friction between the contacting surfaces when the energy applied to the coupler mechanism causes the sliding movement between the contacting surfaces.

Another embodiment is directed to a method of absorbing energy in a railway vehicle coupler comprising a coupler anchor, a coupler mechanism supported to the coupler anchor by a deformation tube and a draft gear mechanism, and at least one energy absorbing device connected to the coupler anchor, the at least one energy absorbing device comprising two mating components in frictional engagement with one another. The method generally comprises applying energy to the coupler mechanism resulting in sliding movement between contacting surfaces of the two components, creating friction between the contacting surfaces, and dissipating the applied energy at least in part in the form of heat energy.

The two mating components may comprise a male part in mating engagement within a female part. The male part may comprise a mounting bolt and the female part may comprise a collar. An inside diameter of the collar may be slightly smaller than an outside diameter of the mounting bolt to create a press-fit engagement therebetween.

The two mating components may comprise a male part within a female part and the frictional engagement therebetween may comprise a press-fit engagement, so that the method may further comprise creating a normal force between the contacting surfaces of the male part and the female part resulting in friction between the contacting surfaces when the energy applied to the coupler mechanism causes the sliding movement between contacting surfaces.

Further details and advantages of the various embodiments detailed herein will become clear upon reviewing the following detailed description of these various embodiments in conjunction with the accompanying drawing figures.

DESCRIPTION OF THE PREFERRED EMBODIMENTS

Figure 1:
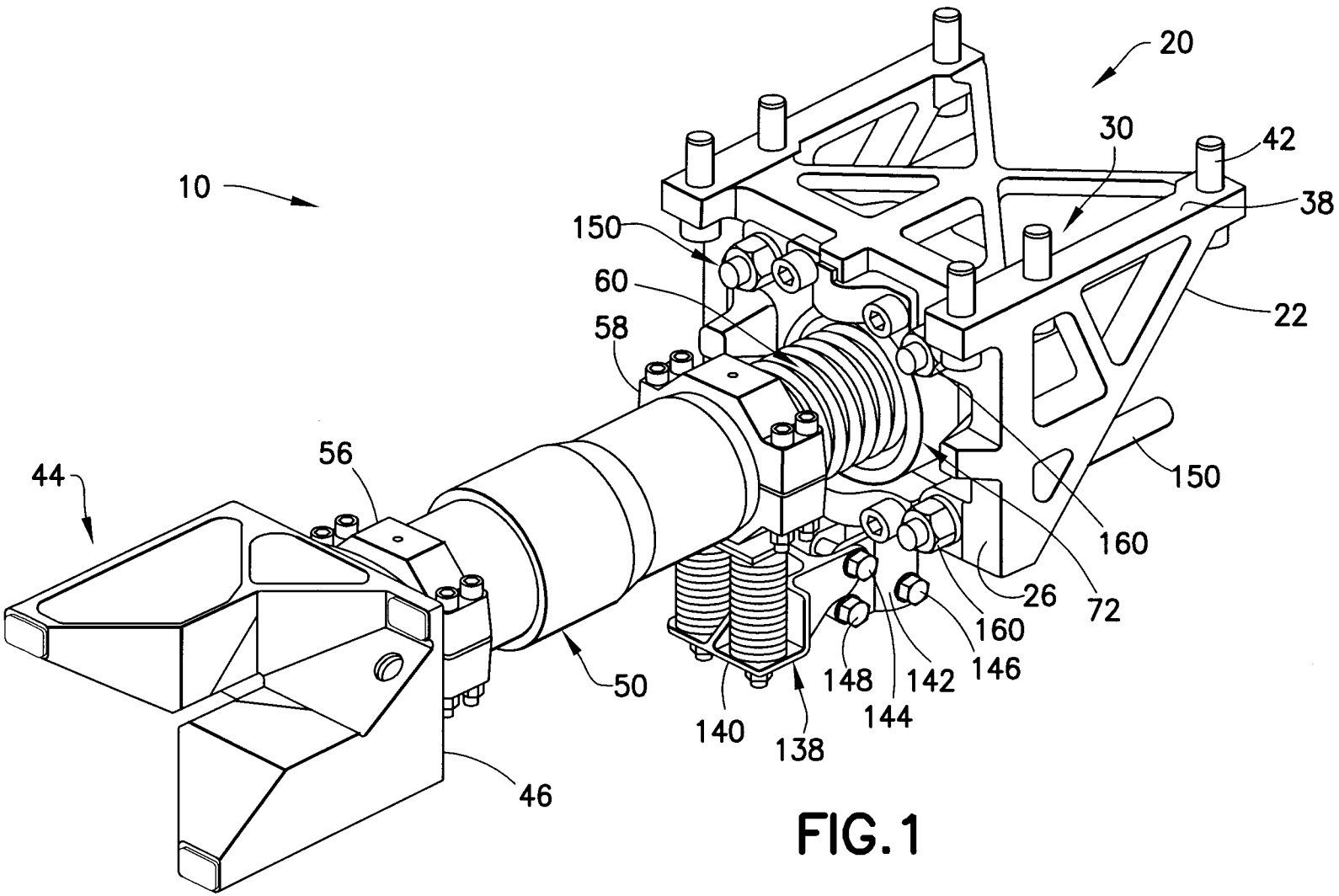
FIG. 1 is a perspective view of an embodiment of an energy absorbing coupler.
Figure 2:
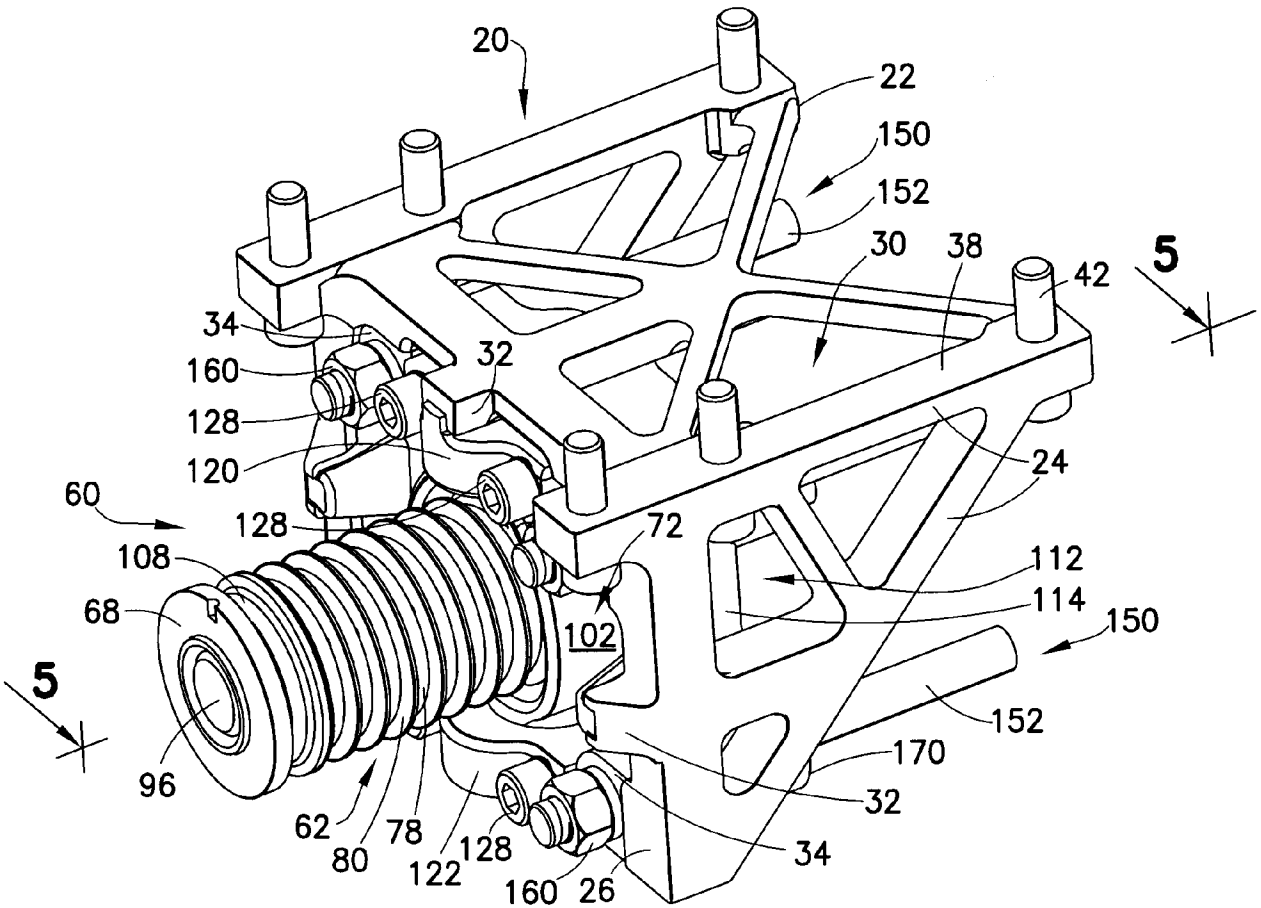
FIG. 2 is a perspective view of the energy absorbing coupler shown in FIG. 1 with a coupler mechanism and a deformation tube therefor removed for clarity.
Figure 3:
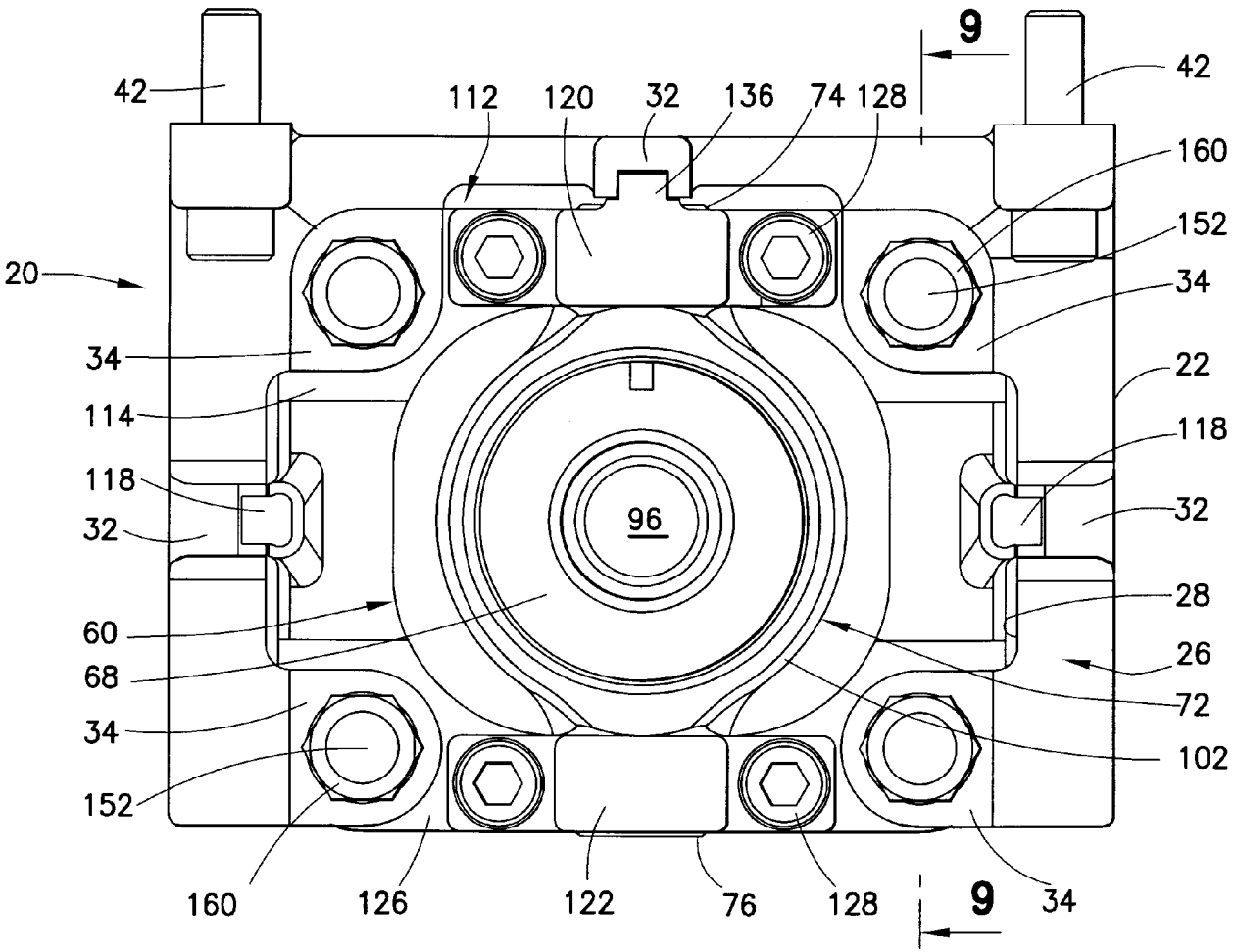
FIG. 3 is a front view of the energy absorbing coupler shown in FIG. 2.
Figure 4:
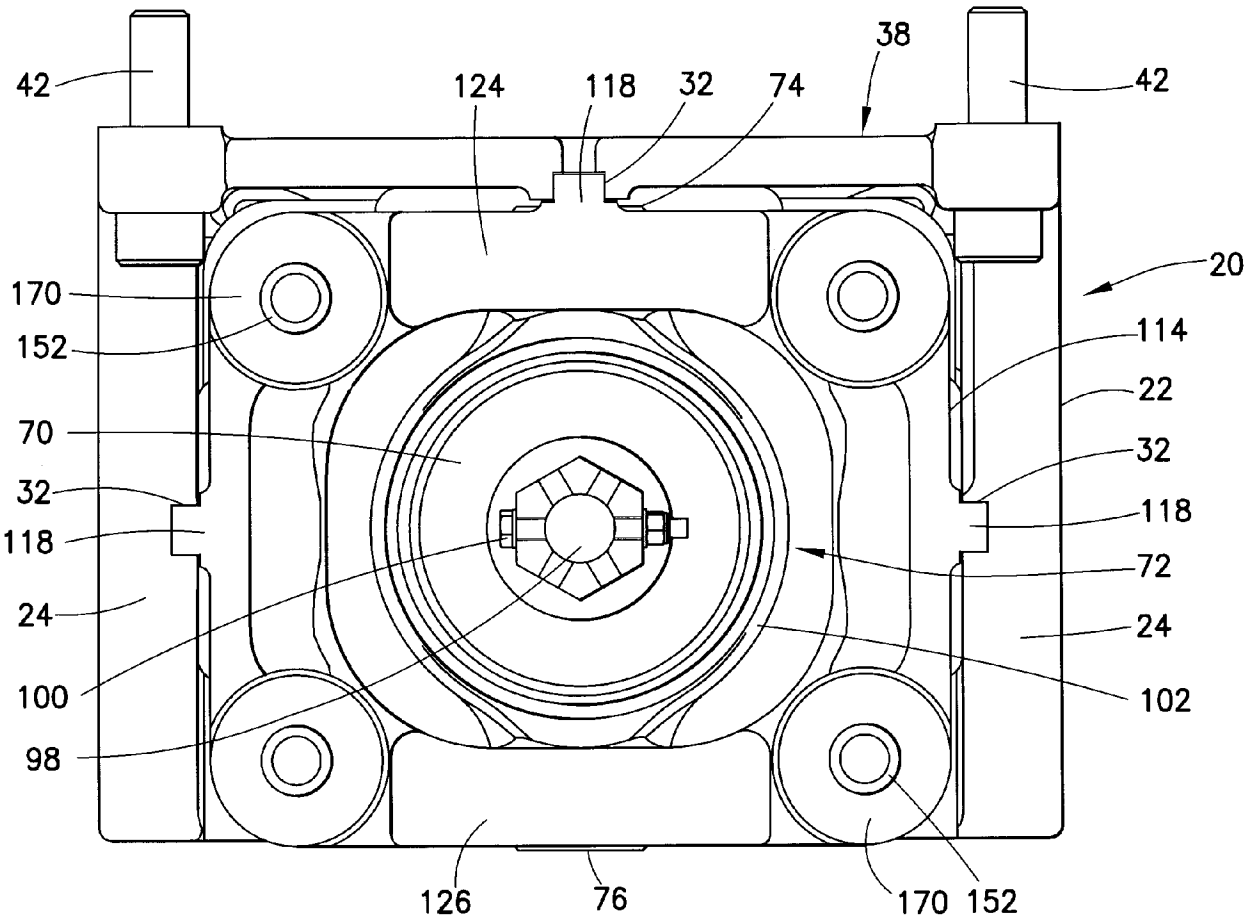
FIG. 4 is a rear view of the energy absorbing coupler shown in FIG. 2.
Figure 5:
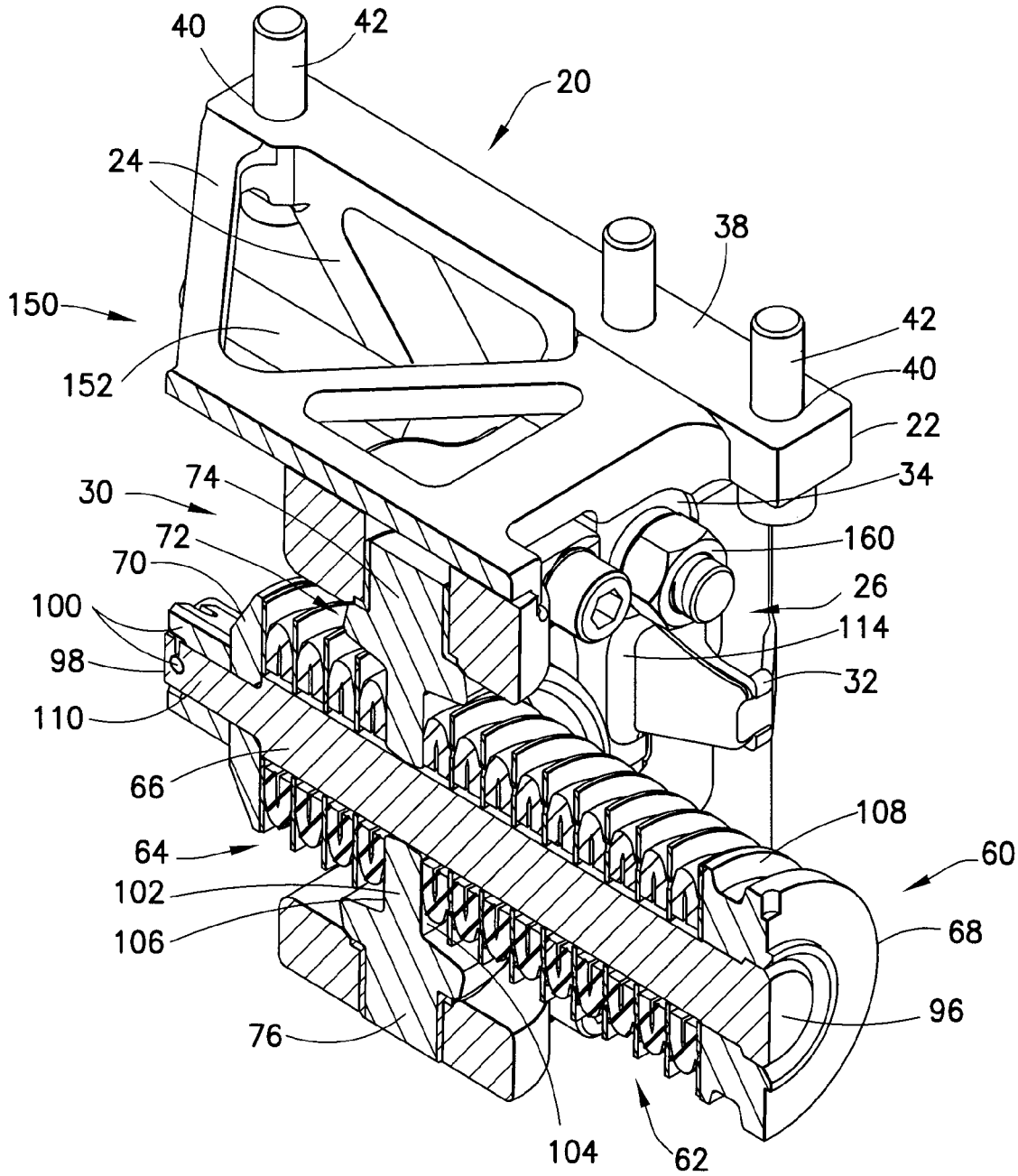
FIG. 5 is a cross-sectional perspective view of the energy absorbing coupler shown in FIG. 2 taken along line 5-5 in FIG. 2.
Figure 6:
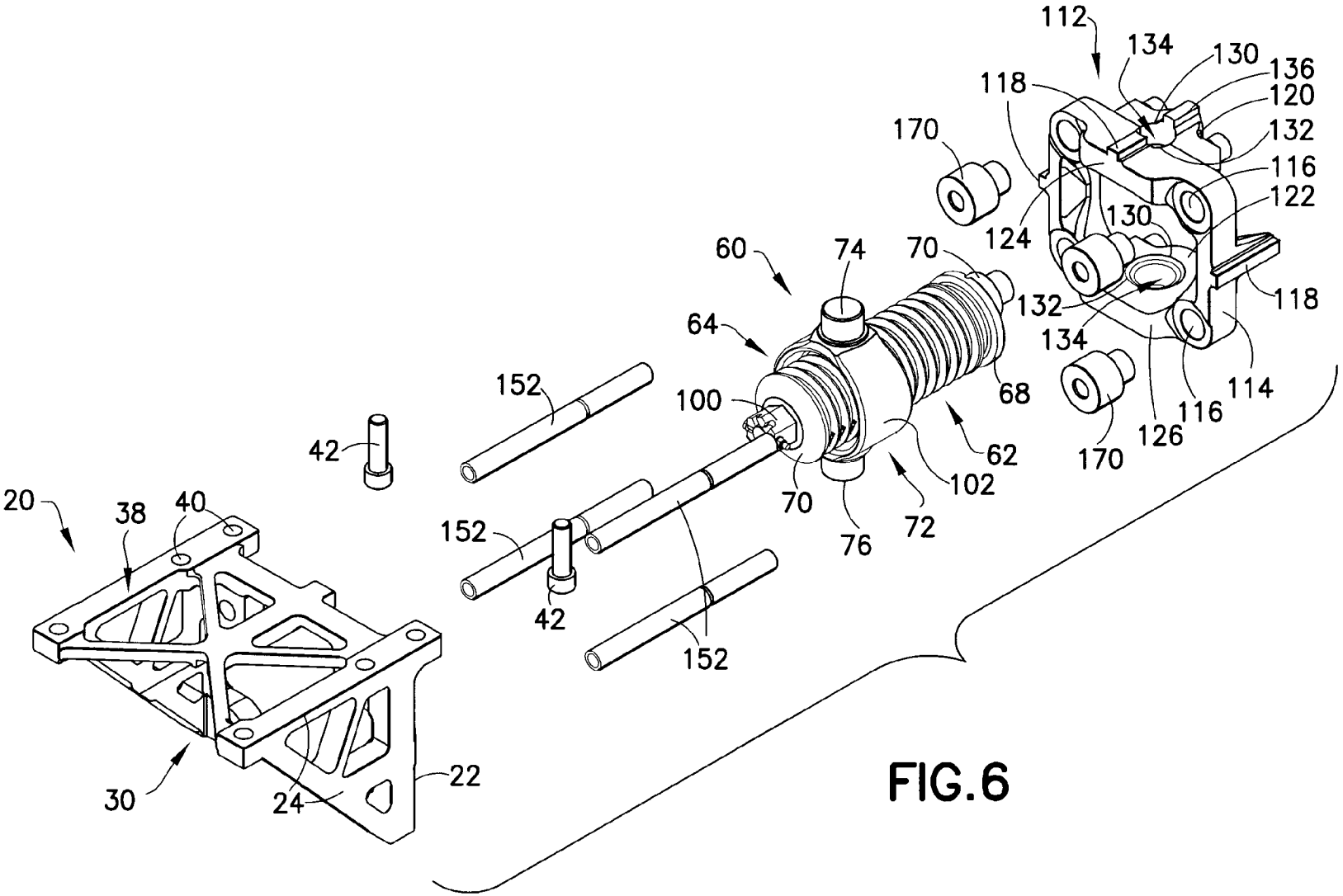
FIG. 6 is an exploded perspective view of the energy absorbing coupler shown in FIG. 2.

For purposes of the description hereinafter, spatial orientation terms, as used, shall relate to the referenced embodiment as it is oriented in the accompanying drawing figures or otherwise described in the following detailed description. However, it is to be understood that the embodiments described hereinafter may assume many alternative variations and configurations. It is also to be understood that the specific components, devices, and features illustrated in the accompanying drawing figures and described herein are simply exemplary and should not be considered as limiting.

Referring to FIGS. 1-6, an embodiment of an energy absorbing coupler 10 is shown. The energy absorbing coupler 10 as described herein is intended for connection to a car frame (not shown) of a railway vehicle (not shown), as will be readily apparent to those skilled in the railway vehicle art. The energy absorbing coupler 10 is desirable for use in mass transit vehicles and like railway vehicles used for passenger mass transit. However, this specific use is intended to be non-limiting and the energy absorbing coupler 10 has applications in railway vehicles generally. The energy absorbing coupler 10 (hereinafter "coupler 10") in the depicted embodiment generally comprises a coupler anchor 20, a coupler mechanism 44, an energy-absorbing deformation tube 50, and an energy absorbing draft gear mechanism 60. The deformation tube 50 is used to connect the coupler mechanism 44 to the coupler anchor 20 by connection to the draft gear mechanism 60. The coupler 10 further comprises one or more energy absorbing devices 150 used to support the draft gear mechanism 60 to coupler anchor 20 and, in particular, to mount the draft gear mechanism 60 to the coupler anchor 20 through use of a supporting slide anchor assembly 112. Thus, the respective energy absorbing devices 150 interface with the slide anchor assembly 112 to secure the draft gear mechanism 60 to the coupler anchor 20.

Figure 9:
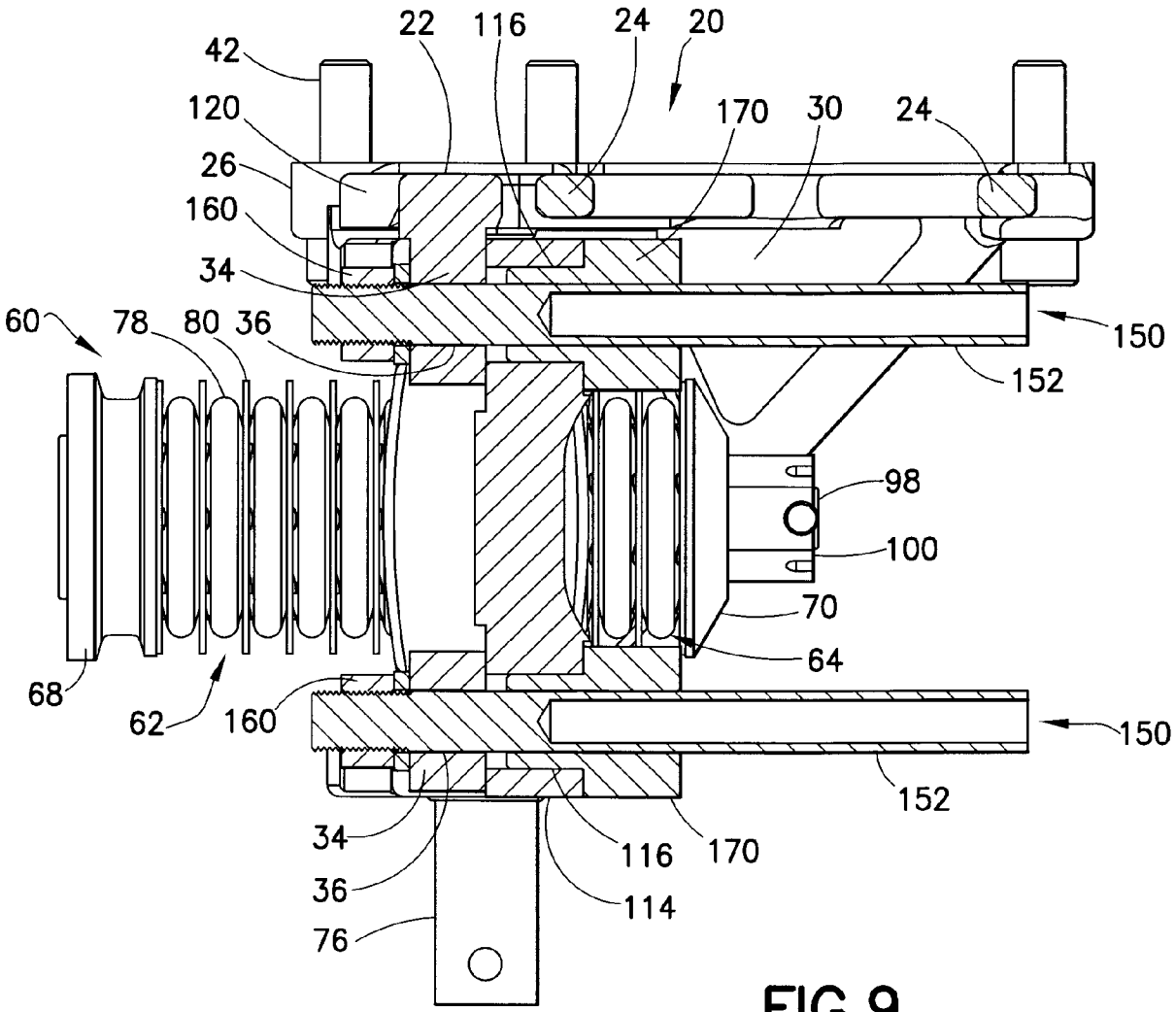
FIG. 9 is a cross-sectional view taken along line 9-9 in FIG. 3.

The coupler anchor 20 comprises a somewhat box-shaped anchor body 22 of generally square or rectangular shape that is truncated, as viewed from its lateral sides, so that the side profile of the anchor body 22 is generally triangular. The anchor body 22 is formed by a series of interconnected structural elements 24. A front face 26 of the anchor body 22 defines a U-shaped front opening 28 and interfaces with the slide anchor assembly 112 which is used to secure the draft gear mechanism 60 to the anchor body 22 desirably in an interior area 30 of the anchor body 22. To interface with the slide anchor assembly 112, the anchor body 22 further comprises one or more grooved supporting locations or elements 32 defined in the structural elements 24 forming the anchor body 22. In the depicted embodiment of the coupler anchor 20, the anchor body 22 has three (3) grooved supporting elements 32 provided at three (3) generally orthogonally-oriented locations around the front opening 28. Additionally, the anchor body 22 comprises one or more corner flanges 34 on the front face 26 of the anchor body 22 for interfacing with the one or more energy absorbing devices 150 and the slide anchor assembly 112 as described herein. The coupler 10 in the embodiment as shown in the drawings includes four (4) energy absorbing devices 150 which interface with the four (4) corner flanges 34. Each corner flange 34 defines an opening 36, which is shown in FIG. 9, to cooperate with an energy absorbing device 150. While four (4) energy absorbing devices 150 which interface with the four (4) corner flanges 34 are illustrated in one desirable embodiment of the coupler 10, this specific arrangement should not be considered exhaustive or limiting as other arrangements using one or a plurality of energy absorbing devices 150 may be provided in accordance with this disclosure and the depicted mounting arrangement with four (4) corner flanges 34 may be altered to suit these alternative arrangements. An upper face 38 of the anchor body 22 may define several apertures 40 which accept securing elements 42 for interfacing with and securing the anchor body 22 with the car frame of a railway vehicle.

Briefly, the coupler mechanism 44 comprises a coupler head 46 to mate the coupler head 46 with a receiving coupler head 46 on an opposing railway vehicle. The coupler mechanism 44 is supported to the coupler anchor 20 by the energy absorbing deformation tube 50, as indicated previously. The deformation tube 50 has a distal end 52 and a proximal end 54. The distal end 52 of the deformation tube 50 is secured to the coupler head 46 of the coupler mechanism 44 by a first coupling connector 56. The proximal end 54 of the deformation tube 50 is secured to the draft gear mechanism 60 by a second coupling connector 58.

Figure 7:
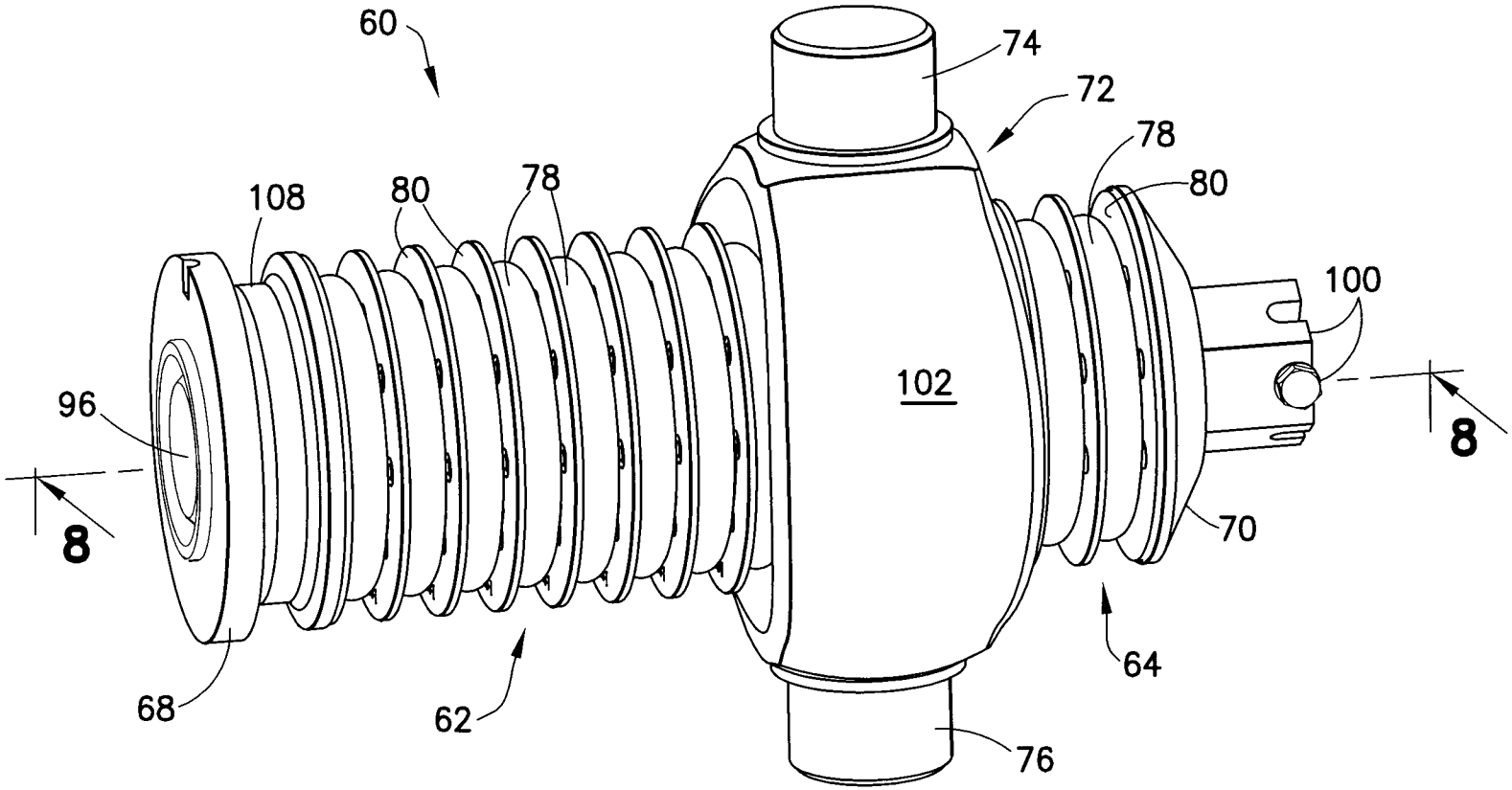
FIG. 7 is a perspective view of an energy absorbing draft gear mechanism for the energy absorbing coupler of FIGS. 1 and 2.
Figure 8:
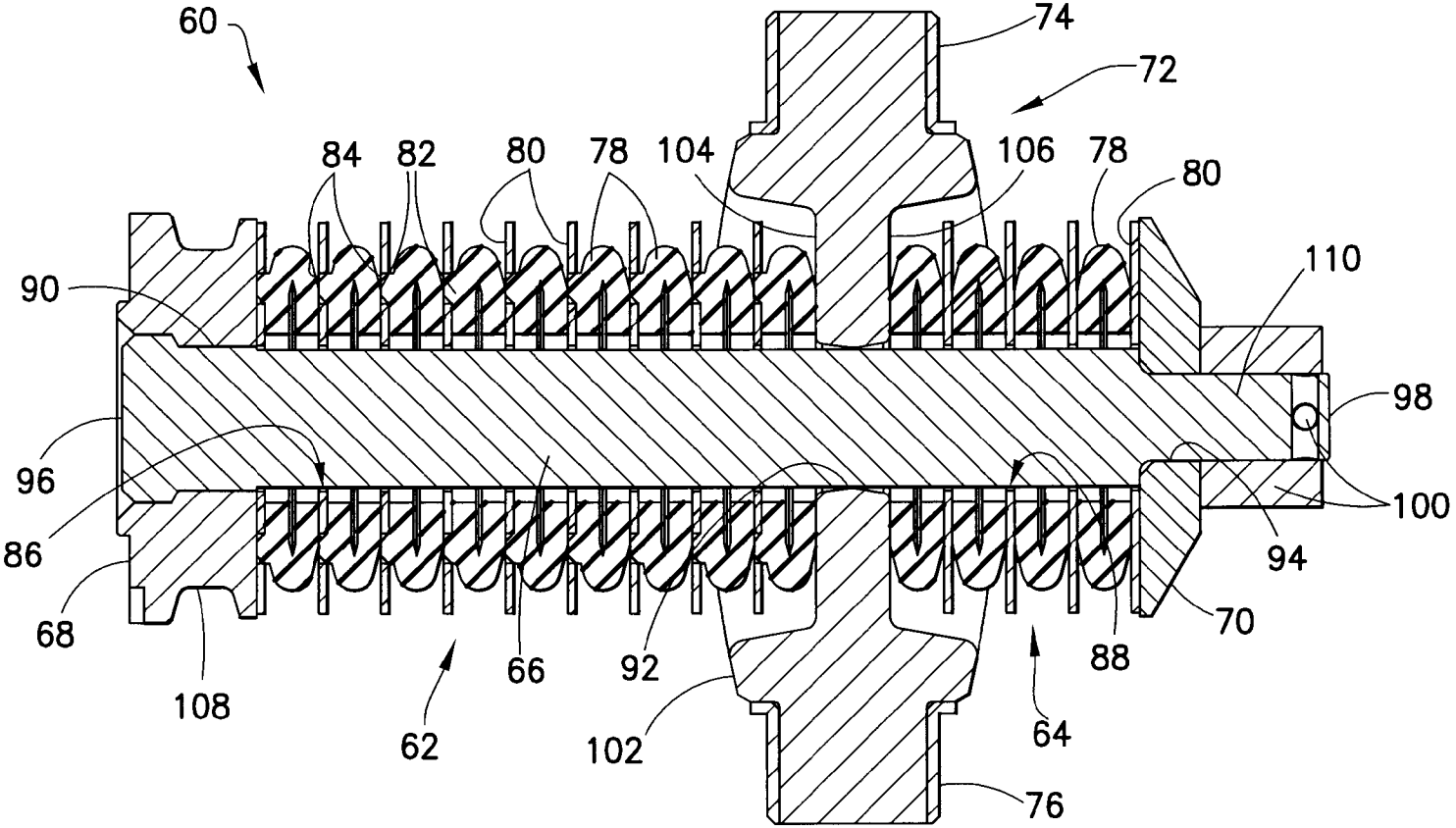
FIG. 8 is a cross-sectional view taken along line 8-8 in FIG. 7.

Referring further to FIGS. 7-8, the draft gear mechanism 60 comprises a forward or distal energy absorbing draft gear tube 62 and a rear or proximal energy absorbing draft gear tube 64. The forward and rear draft gear tubes 62, 64 are supported on a central support shaft 66 and between a distal annular flange 68 and a proximal annular flange 70, each further supported on the support shaft 66. Additionally, the forward or distal draft gear tube 62 and the rear or proximal draft gear tube 64 are separated by an annular mounting support 72 which is also carried on the support shaft 66. The mounting support 72 comprises a top or upper mounting peg 74 and a bottom or lower mounting peg 76 for securing the draft gear mechanism 60 to the anchor body 22 of the coupler anchor 20 as further described herein.

Each of the draft gear tubes 62, 64 is formed by a series of resilient draft gear elements 78 which are individually separated by plate elements 80. As shown in cross-section in FIG. 8, the draft gear elements 78 may be in physical contact with one another by appendages 82 which extend through appendage openings 84 in the respective plate elements 80, as is the case for forward draft gear tube 62. The rear draft gear tube 64 is illustrated with draft gear elements 78 without the foregoing appendages 82 and without the plate elements 80 having the registering appendage openings 84. If desired, the rear draft gear tube 64 may have draft gear elements 78 with the appendages 82 and plate elements 80 with appendage openings 84 or both the rear draft gear tube 64 and the forward draft gear tube 62 may be formed without draft gear elements 78 with appendages 82 and plate elements 80 without appendage openings 84. The forward draft gear tube 62 defines a central bore 86 for passage of the support shaft 66 therethrough. Likewise, the rear draft gear tube 64 defines a central bore 88 for passage of the support shaft 66 therethrough.

The assembly of the draft gear mechanism 60 generally comprises passing the support shaft 66 through an annular opening 90 in the distal annular flange 68, the central bore 86 in the forward draft gear tube 62, an annular opening 92 in the annular mounting support 72, the central bore 88 in the rear draft gear tube 64, and an annular opening 94 in the proximal annular flange 70. The support shaft 66 defines a head or end stop 96 for interference engagement within the annular opening 90 in the distal annular flange 68 and, further, has a proximal end 98 adapted to accept a suitable mechanical fastener 100 or like element to secure the entire assembly of the draft gear mechanism 60.

The mounting support 72 is formed with a collared flange 102 defining a forward or distal plate portion 104 and a rear or proximal plate portion 106. With this construction, it will be understood that the forward draft gear tube 62 is restrained between the forward or distal plate portion 104 and the distal annular flange 68 while the rear draft gear tube 64 is restrained between the rear or proximal plate portion 106 and the proximal annular flange 70. The distal annular flange 68 may further define a circumferential groove 108 for securing a connection with the second coupling connector 58. Thus, the proximal end 54 of the deformation tube 50 is secured to the distal annular flange 68 to support the deformation tube 50 and the associated coupler mechanism 44 to the draft gear mechanism 60. A proximal end portion 110 of the support shaft 66 may have a reduced thickness or diameter to provide an interference engagement connection with the proximal annular flange 70 which is secured by securing fastener 100, thereby securing the mounting of the forward or distal gear tube 62, the mounting support 72, and the rear or proximal gear tube 64 on the support shaft 66.

As noted previously, a supporting slide anchor assembly 112 is used to support the draft gear mechanism 60 to the anchor body 22 of the coupler anchor 20, and generally within the front opening 28 of the anchor body 22. The supporting slide anchor assembly 112 comprises an annular slide anchor 114 having a generally square or rectangular ring shape to define an annular form of the slide anchor 114. The slide anchor 114 has four (4) corner openings 116 that are positioned to coincide with the corner openings 36, which are shown in FIG. 9, in the corner flanges 34 of the anchor body 22 when the slide anchor 114 is assembled to the anchor body 22. The registered corner openings 36, 116 permit the respective energy absorbing devices 150 to be inserted through both sets of corner openings 36, 116 to secure the slide anchor 114 to the anchor body 22 of the coupler anchor 20. The slide anchor 114 is desirably a unitary structure and comprises three (3) outward projecting guide rail elements 118. The guide rail elements 118 are generally orthogonally arranged on the exterior of the slide anchor 114 so that the respective guide rail elements 118 may cooperate with the three (3) grooved supporting elements or locations 32 formed in the structural elements 24 of the anchor body 22 of the coupler anchor 20 when the slide anchor 114 is assembled to the anchor body 22 using the energy absorbing devices 150.

The draft gear mechanism 60 is secured to the slide anchor 114 by an upper clamp element 120 and a lower clamp element 122. The upper and lower clamp elements 120, 122 are secured to respective upper and lower cross legs 124, 126 of the slide anchor 114 by use of mechanical fasteners 128, desirably bolts, that thread into engagement into threaded openings (not shown) in the front faces of the respective upper and lower cross legs 124, 126. Additionally, the upper and lower clamp elements 120, 122 each define a recessed area 130 intended to face corresponding recessed areas 132 in the front face of each of the upper and lower cross legs 124, 126. Accordingly, once the clamp elements 120, 122 are assembled to the upper and lower cross legs 124, 126, upper and lower peg openings 134 are formed by the opposing recessed areas 130, 132, with the peg openings 134 sized to accept the upper and lower mounting pegs 74, 76 on the mounting support 72 of the draft gear mechanism 60.

To assemble the draft gear mechanism 60 to the supporting slide anchor assembly 112, the upper and lower mounting pegs 74, 76 are positioned within the recessed areas 132 defined in the upper and lower cross legs 124, 126 of the slide anchor 114 and the upper and lower clamp elements 120, 122 are positioned against the upper and lower cross legs 124, 126 to receive the mounting pegs 74, 76 into the corresponding recessed areas 130 defined in the respective clamp elements 120, 122. The clamp elements 120, 122 thus capture the mounting pegs 74, 76 within the upper and lower peg openings 134 formed by the mutually facing recessed areas 130, 132 when the upper and lower clamp elements 120, 122 are positioned against the upper and lower cross legs 124, 126. The securing mechanical fasteners 128 may then be inserted through openings (not shown) in the respective clamp elements 120, 122, with the mechanical fasteners 128 desirably engaging threaded openings (not shown) in the front face of the respective upper and lower cross legs 124, 126. This arrangement secures the draft gear mechanism 60 to the slide anchor assembly 112. If desired, the deformation tube 50 carrying the coupler mechanism 44 may be preassembled to the draft gear mechanism 60 in the manner described hereinabove prior to securing the draft gear mechanism 60 to the slide anchor assembly 112. Further, it will be understood from viewing FIG. 6, for example, that the upper clamp element 120 may have an upstanding guide rail element 136 aligned with the top guide rail element 118 on the upper cross leg 124 of the slide anchor 114 of the slide anchor assembly 112.

The supporting slide anchor assembly 112, with the draft gear mechanism 60 secured thereto, may be assembled to the coupler anchor 20 as now described hereinafter. The slide anchor assembly 112 is positioned within the interior area 30 of the anchor body 22 of the coupler anchor 20 so that the respective guide rail elements 118 are positioned to align with and slide into engagement with the corresponding grooved supporting elements 32 in the structure elements 24 of the anchor body 22. As will be understood from the views in FIGS. 3-5, the slide anchor assembly 112 supporting at least the draft gear mechanism 60 is positioned within the front opening 28 in the anchor body 22 from the interior area 30 of the anchor body 22 so that the respective guide rail elements 118 are positioned to align with and slide into engagement with the corresponding grooved supporting elements 32 in the structural elements 24 of the anchor body 22. This engagement also automatically aligns the corner openings 116 in the slide anchor 114 with the corner openings 36 in the corner flanges 34 of the anchor body 22. Additionally, the engagement of the respective guide rail elements 118 with the corresponding grooved supporting elements 32 in the structural elements 24 of the anchor body 22 provides lateral stability to the draft gear mechanism 60, deformation tube 50, and coupler mechanism 44 within the anchor body 22 of the coupler anchor 20 during operation of the coupler 10. At this point, the deformation tube 50, typically with the coupler mechanism 44 previously attached thereto, may be mounted to the draft gear mechanism 60, in the manner described previously, if not already connected to the draft gear mechanism 60.

The draft gear mechanism 60 may also optionally comprise a vertical support mechanism 138 supported by the lower cross leg 126 and/or lower clamp element 122 of the slide anchor assembly 112. The vertical support mechanism 138 comprises a single or multi-spring support element 140 which vertically supports the second coupling connector 58 from underneath. This spring support element 140 may be pivotally supported to a second support element 142 by a suitable mechanical fastener 144 such as a pin or a bolt and nut combination. The second support element 142 may be supported to one or both of the lower cross leg 126 and lower clamp element 122 again by a suitable mechanical fastener 146 such as a pin or a bolt and nut combination. As an option as shown in FIG. 9, the lower mounting peg 76 on the mounting support 72 may be elongated to provide a mounting location for the second support element 142, such that the securing mechanical fastener 146 may pass through the lower mounting peg 76 thereby supporting the vertical support mechanism 138 to the slide anchor assembly 112. An additional mechanical fastener 148 of suitable design may be provided to extend through the second support element 142 to limit the downward pivotal movement of the spring support element 140.

Figure 10:
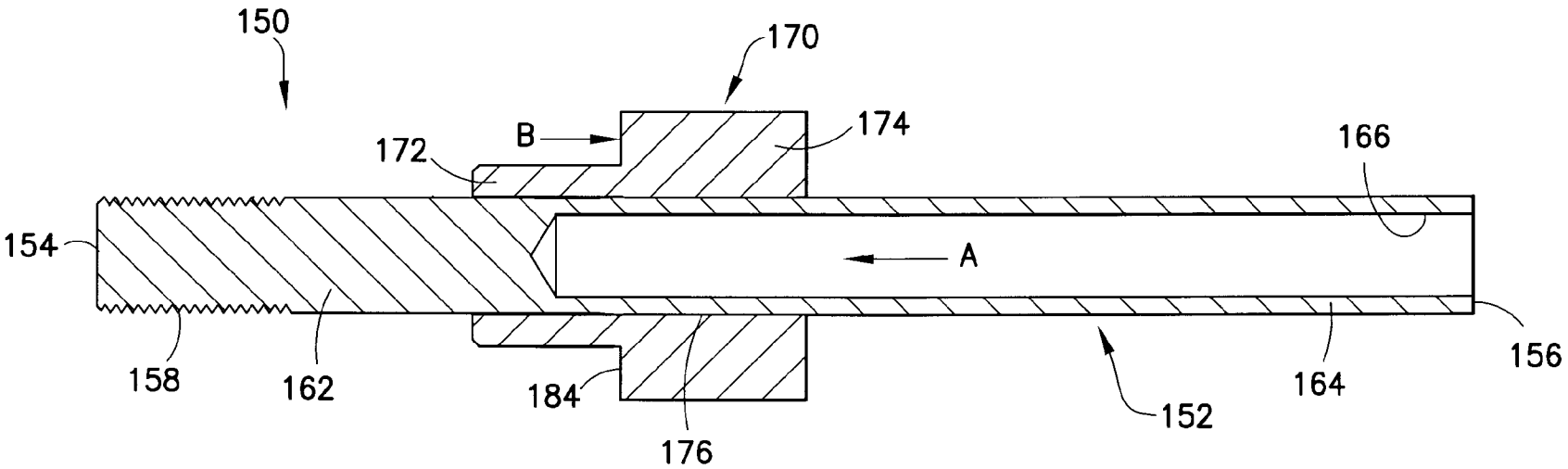
FIG. 10 is a cross-sectional isolation view of an energy absorbing device used in the energy absorbing coupler of FIGS. 1 and 7.
Figure 11:
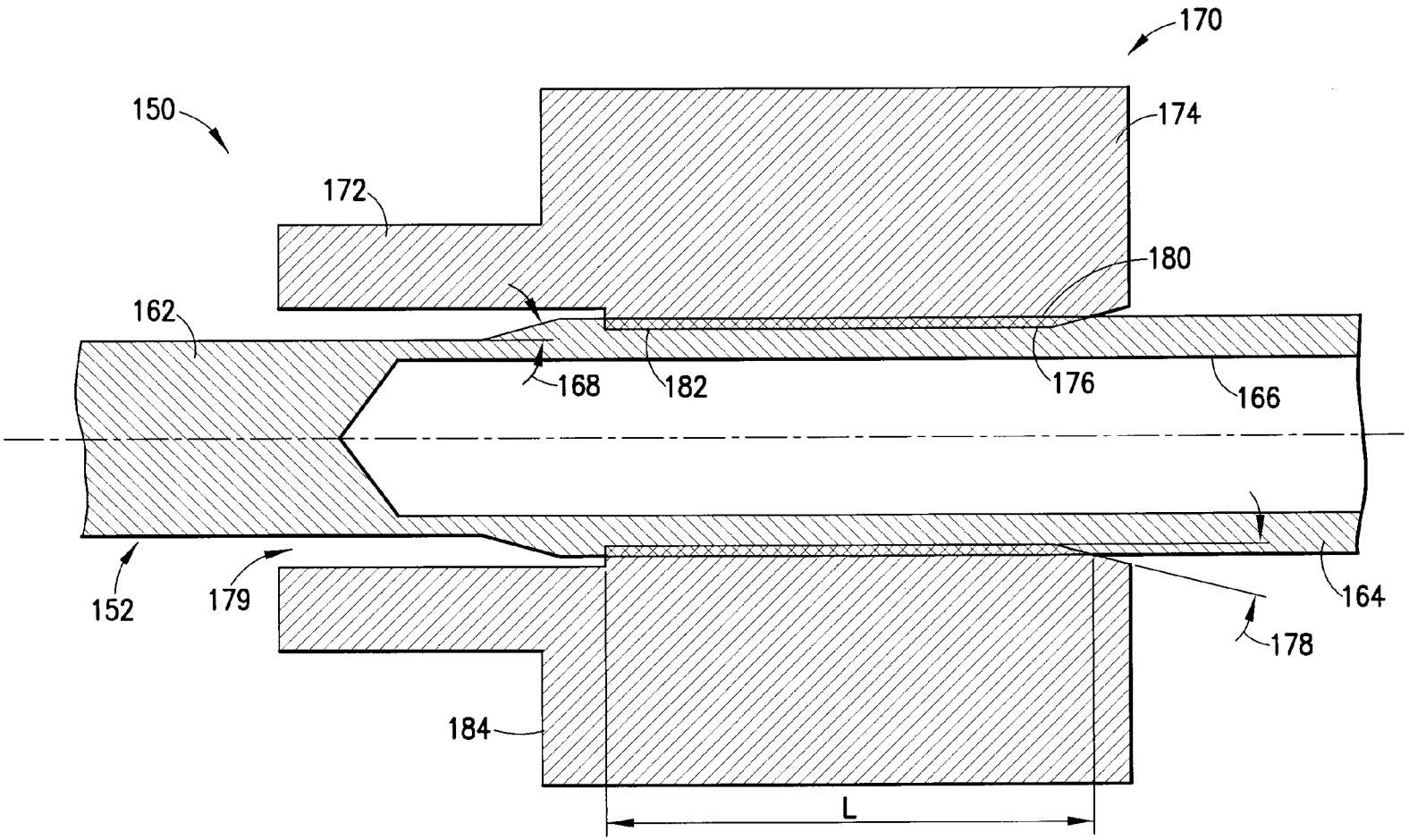
FIG. 11 is an enlarged view of a portion of the energy absorbing device shown in FIG. 10.

The energy absorbing devices 150 are used to secure the slide anchor 114 to the anchor body 22 of the coupler anchor 20. Referring further to FIGS. 9-11, the respective energy absorbing devices 150 each comprise two mating components in a press-fit frictional engagement and, namely, a male part or component desirably in the form of a mounting bolt 152 and a female part or component desirably in the form of a collar 170. The mounting bolt 152 has a distal end 154 and a proximal end 156. The distal end 154 of the mounting bolt 152 has an externally threaded portion 158 to accept a threaded mounting nut 160 in a conventional threaded fashion. The threaded distal end 154 and mounting nut 160 are used to mount the energy absorbing device 150 to the anchor body 22, which is in turn connected to the car frame of a railway vehicle using conventional mechanical arrangements. A distal portion 162 of the mounting bolt 152 may have a solid cross section while a proximal portion 164 of the mounting bolt 152 may be hollow as defined by a bore hole 166. The mounting bolt 152 has a lead-in chamfer 168 proximal of the solid cross-section distal portion 162 of the mounting bolt 152 where the outer diameter (OD) of the mounting bolt 152 increases to be slightly larger the outer diameter (OD) of the solid cross-sectional distal portion 162 of the mounting bolt 152 (e.g., the hollow proximal portion 164 of the mounting bolt has a slightly larger outer diameter than the distal portion 162).

The respective energy absorbing devices 150 each further comprise a collar 170 typically having a first portion 172 and a second portion 174 and defining a central opening 176 between the first and second ends 172, 174. The central opening 176 has a lead-in chamfer 178, typically a machined lead-in chamfer, in the second portion 174 of the collar 170. The inner diameter (ID) of the central opening 176 is desirably smaller, over at least a portion of its length, than the outside diameter (OD) of the mounting bolt 152 that is proximal of the distal portion 162 of the mounting bolt 152 so that a press-fit overlap area or length L is defined between the inner diameter (ID) of the central opening 176 and the outer diameter (OD) of the mounting bolt 152. This difference in diameters between the central opening 176 and the mounting bolt 152 and, more particularly, between the inside diameter (ID) of the central opening 176 forward or distal of the chamfer 178 and the outside diameter (OD) proximal of the chamfer 168 on the mounting bolt 152 allows for a press-fit frictional engagement to be established between the mounting bolt 152 and the collar 170. Bore hole diameter 166 in the mounting bolt 152 also plays a part in determining the force with which the mounting bolt 152 will slide through the collar 170 (e.g., the smaller the bore hole, the higher the force). Additionally, the length L of the press-fit between central opening 176 in the collar 170 and the mounting bolt 152 is important in determining the force with which the mounting bolt 152 will slide through the collar 170. As shown in FIG. 11, the central opening 176 through the first portion 172 of the collar 170 is enlarged, as designated by reference numeral 179, relative to the second portion 174 this first portion 172 may be omitted from the collar 170 if desired as it is provided as a spacer element in the shown embodiment of the collar 170.

Accordingly, the outside diameter (OD) of the mounting bolt 152 proximal of the chamfer 168 forms an exterior contacting surface 180 which engages a mating interior contacting surface 182 of the collar 170 as defined by the central opening 176 through the collar 170. The overlapping length L is formed by the press-fit between contacting surfaces 180, 182. As shown in FIGS. 9-11, the second portion 174 of the collar 170 has an increased thickness (diameter) relative to the first portion 172, which is of smaller thickness (diameter), thereby defining a distal facing shoulder 184. To obtain the desired press-fit between the mounting bolt 152 and the collar 170, the mounting bolt 152 may be inserted distal end 154 first into the central opening 176 in the collar 170 from the second portion 174 of the collar 170 in the direction shown by arrow A in FIG. 10. In this manner, the opposing chamfers 168, 178 on the mounting bolt 152 and interiorly in the central opening 176, respectively, initially contact one another to properly align the mounting bolt 152 and the collar 170 for the press-fit operation. The press-fit between the contacting surfaces 180, 182 of the mounting bolt 152 and the collar 170 is obtained by applying force in the direction of arrow A and a corresponding force in the direction of arrow B in FIG. 10 to the collar 170, with such force being applied to the shoulder 184 on the collar 170.

As noted previously, the energy absorbing devices 150 are used to secure the slide anchor assembly 112 to the coupler anchor 20. As further noted previously, when the slide anchor assembly 112 supporting at least the draft gear mechanism 60 is secured to the anchor body 22, there is engagement between the respective guide rail elements 118 on the slide anchor 114 and the corresponding grooved supporting elements 32 in the structural elements 24 of the anchor body 22. This engagement also automatically aligns the corner openings 116 in the slide anchor 114 with the corner openings 36 in the corner flanges 34 of the anchor body 22, as also noted previously. The distal end 154 of the respective mounting bolts 152 may be inserted through the corner openings 116 in the slide anchor 114 of the slide anchor assembly 112 from the interior area 30 of the anchor body 22 and then through the registered corner openings 36 in the corner flanges 34 of the anchor body 22. A threaded nut 160 may then be applied to the externally thread portion 158 at the distal end 154 of each of the mounting bolts 152. Desirably, each of the mounting bolts 152 has the collar 170 press-fitted in advance onto the respective mounting bolts 152. Additionally, the corner openings 116 in the slide anchor 114 of the slide anchor assembly 112 are desirably sized sufficiently large (in diameter) to accept in frictional engagement therein the first portion 172 of the respective collars 170. As a result, the forward or distal facing shoulder 184 on each of the collars 170 abuts against a rear face or side of the upper or lower cross legs 124, 126 of the slide anchor 114. With the slide anchor assembly 112 secured to the coupler anchor 20 in the foregoing manner, the anchor body 22 may be affixed to the car frame of a railway vehicle. As noted in the foregoing, the slide anchor assembly 112 supports at least the draft gear mechanism 60 at this point of the assembly process. After attaching the coupler anchor 20 to the railway vehicle frame, the deformation tube 50 may be affixed to the draft gear mechanism 60 with the deformation tube 50 ideally already having the coupler mechanism 44 attached thereto. Alternatively, the deformation tube 50, typically carrying the coupler mechanism 44, may be secured to the draft gear mechanism 60 prior to attaching the coupler anchor 20 to the railway vehicle frame. The sequence for securing the deformation tube 50 to the draft gear mechanism 60 and securing the coupler mechanism 44 to the deformation tube 50 may be altered as desired to effect overall assembly of the coupler 10 and its attachment to the frame of a railway vehicle.

The energy absorbing devices 150 are force limiting, energy absorbing devices that can be used as replacements for the overload shear release bolts/bushings described previously. As noted previously, the purpose behind having these overload shear release bolts/bushings is to limit the maximum load transferred from a coupler to a car frame. Force levels otherwise could exceed this maximum load during a hard coupling or collision with another car, possibly leading to passenger injury or death. In operation, in a hard coupling or collision as the coupler anchor 20 slides backward toward the car frame, the energy absorbing devices 150 absorb energy at a predetermined load. The press-fit release energy absorption feature provided by the energy absorbing devices 150 is the result of the inside diameter (ID) of the collar 170 being slightly smaller than the outside diameter (OD) of the mounting bolt 152. This creates a press-fit between the outside contacting surface 180 of the mounting bolt 152 and the mating interior contacting surface 182 of the collar 170 in the central opening 176 of the collar 170. In operation, as the shaft of the mounting bolt 152 is pulled through the collar 170, energy is absorbed in the form of heat into these two parts or components. This energy absorbing feature is the result of the press-fit creating a normal force (e.g., generally perpendicular force) to the mating contacting surfaces 180, 182 of the mounting bolt 152 and the collar 170, respectively, thus creating friction as one contacting surface 180, 182 slides over the other contacting surface 180, 182. Deformation may or may not take place in the mounting bolt 152 and/or the collar 170 absorbing additional energy.

One benefit of the energy absorbing coupler 10 incorporating the press-fit mounting bolt 152 and collar 170 design over the previously discussed overload shear release bolt/bushing design is that the energy absorbing coupler 10 absorbs energy, whereas the shear release bolt/bushing design only limits the load that is transferred from the coupler anchor to the car frame. This transferred energy then has to be absorbed by the car frame. Another benefit is the elimination of a stress riser in the shear plane of the overload shear release bolt/bushing design. The overload shear release bolt/bushing design is designed to fail (shear) at the shear plane which creates a stress riser at this plane. Given the variable loading mass transit cars encounter during typical operation, this weak point is prone to fatigue failure. The energy absorbing coupler 10 eliminates this stress riser while still allowing the two components, namely, the mounting bolt 152 and the collar 170, to "stroke" when the load reaches a critical level and, therefore, greatly reducing the chance of fatigue failure.

Thus, the energy absorbing coupler 10 may be used to replace both the overload shear release bolts/bushings known in the prior art and a deformation tube, if desired, in known coupler designs. It may be desirable in certain applications to eliminate the use of a deformation tube 50 and reduce the overall length of the coupler 10. However, the energy absorbing coupler 10 including a deformation tube 50, as described in the foregoing description, provides enhanced energy absorption characteristics.

While embodiments of an energy absorbing coupler 10 for railway and like vehicles and methods of assembly and operation thereof were provided in the foregoing description, those skilled in the art may make modifications and alterations to these embodiments without departing from the scope and spirit of the invention. Accordingly, the foregoing description is intended to be illustrative rather than restrictive. The invention described hereinabove is defined by the appended claims and all changes to the invention that fall within the meaning and the range of equivalency of the claims are to be embraced within their scope.

The invention claimed is:

1. An energy absorbing coupler for railway vehicles, comprising:

a coupler anchor; and at least one energy absorbing device connected to the coupler anchor;

wherein the at least one energy absorbing device comprises two mating components in frictional engagement with one another, and wherein energy applied to the coupler causes sliding movement between contacting surfaces of the two components thereby creating friction and dissipating the applied energy at least in part in the form of heat energy; and wherein the two mating components comprise a mounting bolt and a collar.

2. An energy absorbing coupler as in claim 1, wherein an inside diameter of the collar is slightly smaller than an outside diameter of the mounting bolt to create a press-fit engagement therebetween.

3. An energy absorbing coupler as in claim 2, wherein the press-fit engagement creates a normal force between the contacting surfaces of the collar and the mounting bolt resulting in friction between the contacting surfaces when the energy applied to the coupler causes the sliding movement between the contacting surfaces.

4. An energy absorbing coupler as in claim 1, wherein the frictional engagement between the mounting bolt and the collar comprises a press-fit engagement.

5. An energy absorbing coupler as in claim 4, wherein the press-fit engagement creates a normal force between the contacting surfaces of the mounting bolt and the collar resulting in friction between the contacting surfaces when the energy applied to the coupler causes the sliding movement between the contacting surfaces.

6. An energy absorbing coupler for railway vehicles, comprising:

a coupler anchor;

a coupler mechanism supported to the coupler anchor by a deformation tube and a draft gear mechanism; and at least one energy absorbing device connected to the coupler anchor;

wherein the at least one energy absorbing device comprises two mating components in frictional engagement with one another, and wherein energy applied to the coupler mechanism causes sliding movement between contacting surfaces of the two components thereby creating friction and dissipating the applied energy at least in part in the form of heat energy; and wherein the two mating components comprise a mounting bolt and a collar.

7. An energy absorbing coupler as in claim 6, wherein an inside diameter of the collar is slightly smaller than an outside diameter of the mounting bolt to create a press-fit engagement therebetween.

8. An energy absorbing coupler as in claim 7, wherein the press-fit engagement creates a normal force between the contacting surfaces of the collar and the mounting bolt resulting in friction between the contacting surfaces when the energy applied to the coupler mechanism causes the sliding movement between the contacting surfaces.

9. An energy absorbing coupler as in claim 6, wherein the frictional engagement between the mounting bolt and the collar comprises a press-fit engagement.

10. An energy absorbing coupler as in claim 9, wherein the press-fit engagement creates a normal force between the contacting surfaces of the mounting bolt and the collar resulting in friction between the contacting surfaces when the energy applied to the coupler mechanism causes the sliding movement between the contacting surfaces.

11. An energy absorbing coupler as in claim 6, wherein the draft gear mechanism comprises resilient draft gear elements.

12. A method of absorbing energy in a railway vehicle coupler, the railway vehicle coupler comprising:

a coupler anchor;

a coupler mechanism supported to the coupler anchor by a deformation tube and a draft gear mechanism; and at least one energy absorbing device connected to the coupler anchor, the at least one energy absorbing device comprising two mating components in frictional engagement with one another;

the method comprising:

applying energy to the coupler mechanism resulting in sliding movement between contacting surfaces of the two components;

creating friction between the contacting surfaces;

dissipating the applied energy at least in part in the form of heat energy; and wherein the two mating components comprise a mounting bolt and a collar.

13. A method as in claim 12, wherein an inside diameter of the collar is slightly smaller than an outside diameter of the mounting bolt to create a press-fit engagement therebetween.

14. A method as in claim 12, wherein the frictional engagement between the mounting bolt and the collar comprises a press-fit engagement, the method further comprising creating a normal force between the contacting surfaces of the mounting bolt and the collar resulting in friction between the contacting surfaces when the energy applied to the coupler mechanism causes the sliding movement between contacting surfaces.

* * * * *